US005749480A

United States Patent [19]

Wood

[11] Patent Number: 5,749,480

[45] Date of Patent: May 12, 1998

[54] PIVOTAL DISPLAY RACK

[75] Inventor: Graham Robert Wood, Glencoe, Ill.

[73] Assignee: Stamford Investments, Inc., Prospect Hts., Ill.

[21] Appl. No.: 785,649

[22] Filed: Jan. 17, 1997

[51] Int. Cl.[6] ..... A47F 5/12

[52] U.S. Cl. ..... 211/169.1; 211/150; 211/99; 248/242

[58] Field of Search ..... 211/150, 99, 169.1; 40/729, 733, 734; 248/242, 292.12

[56] References Cited

U.S. PATENT DOCUMENTS

| | | | |
|---|---|---|---|
| 1,705,237 | 3/1929 | Bulman . | |
| 2,963,170 | 12/1960 | Lori . | |
| 3,044,674 | 7/1962 | Levy . | |
| 3,151,576 | 10/1964 | Patterson | 211/150 |
| 3,426,993 | 2/1969 | Johansson . | |
| 3,561,713 | 2/1971 | Berkowitz . | |
| 3,795,379 | 3/1974 | Gray | 248/242 |
| 3,861,638 | 1/1975 | Tong . | |
| 4,350,098 | 9/1982 | Shirono et al. . | |
| 4,934,645 | 6/1990 | Breslow | 248/242 |
| 5,502,929 | 4/1996 | Daniels . | |

FOREIGN PATENT DOCUMENTS

| | | | |
|---|---|---|---|
| 2501349 | 7/1976 | Germany | 248/242 |
| 595280 | 8/1959 | Italy | 211/150 |
| 601781 | 2/1960 | Italy | 248/242 |

OTHER PUBLICATIONS

ALU Catalogue, Frame Collections (3 pages), ALU, New York, New York, 1996.

*Primary Examiner*—Milton Nelson, Jr.
*Assistant Examiner*—Anthony D. Barfield
*Attorney, Agent, or Firm*—Welsh & Katz

[57] ABSTRACT

A display rack for supporting a shelf-like member in a range of inclinations includes upright, generally vertically oriented support members, each defining a longitudinal axis and each having at least two spaced apart support pegs extending therefrom, generally transverse to the longitudinal axis. A support bracket defining a mounting plane and mountable to the shelf-like member and the support member includes an arcuate portion and a straight portion contiguous therewith defining an open central region. The straight portion defines a central notch therein, and the arcuate portion defines a plurality of spaced apart, circumferential, radially oriented notches formed therein contiguous with the open central region. The bracket is engageable with the support pegs such that a lower one of the support pegs engages the central notch and an upper one of the support peg engages a selected one of the radially oriented notches to orient the shelf-like member at a selected orientation. The system is configured such that successive engagement of the upper support peg with each of the radially oriented notches defines a range of inclinations of the shelf-like member relative to the longitudinal axis of the support member of about 180°.

10 Claims, 3 Drawing Sheets

PIVOTAL DISPLAY RACK

FIELD OF THE INVENTION

This invention relates to a pivotable, multi-inclination angle display rack. More particularly, the invention relates to a pivotable, multi-inclination angle display-type rack having a display surface or shelf that is positionable in one of a plurality of orientations in a range of inclinations of about 360°.

BACKGROUND OF THE INVENTION

Display racks are well known in the art. Such racks can be used, for example, for providing a display unit to display art or promotional material. Consumers will likely recognize portable booths or kiosks that can be erected in a free-standing manner in the street or on a sidewalk for such display purposes. Such display racks may be used by artists at art fairs, for displaying their work. The racks can also be used for displaying promotional or other advertising media, for example, at trade shows and the like.

Known display racks provide little flexibility in display design and layout. Such racks are designed and erected to provide only a fixed, relatively vertical orientation for display of the media. One known rack configuration provides the ability to incline a shelf through a relatively small range of angles to permit the shelf to hold and display media at angles that appear to be between about 30° above and below the horizontal. The shelves are bolted or otherwise positionally fixed to a rack supporting structure. Whereas this system may be useful in some display arrangements, it would be desirable to have more flexibility in designing and arranging such displays.

In another known type of display rack, the display media is mounted to a frame. The frame has dowels or pegs extending outwardly from the sides thereof. The frame is mounted in a larger frame, such as a floor standing frame. The floor standing frame has mounting brackets that mount to the sides thereof and are adapted to receive the dowels that extend from the sides of the media frame. The mounting brackets may include threaded fasteners, such as thumb screws, that can be used to fix the position of the framed media.

This type of display rack system has a number of drawbacks. For example, the position of the media is fixed only as well as the frame is secured in place by the mounting brackets. If the dowel joints of the mounting brackets are not sufficiently tightened and the media is pushed downward or upward, the position of the media will be changed. While this may not appear to be problematic, many such displays require numerous media pieces to be precisely placed and positioned, and even the slightest out of positioning of the media pieces can require a significant amount of time and effort to correct.

Accordingly, there continues to be a need for a pivotable display rack for supporting one or more shelf-like members, independent of each other, in a range of inclinations. Preferably, such a rack is configured to permit the shelf-like members to be readily pivoted through their respective ranges of inclinations without tools and without disassembly of any portion of the rack structure.

SUMMARY OF THE INVENTION

A display rack system for supporting a shelf-like member, such as artist's media and the like, in a range of inclinations, provides ease of use, assembly and disassembly. The rack system includes at least one vertical, upright support member having at least two spaced apart support pegs extending therefrom.

The media includes a support bracket mounted thereto, defining a mounting plane. The bracket includes an arcuate portion and a straight portion contiguous therewith, defining an open central region. The straight bracket portion defines a central notch therein at about a midpoint thereof. The arcuate portion defines a plurality of circumferentially spaced apart, radially oriented notches formed therein contiguous with the open central region.

The bracket, when mounted to the media, is engageable with the support pegs such that one of the support pegs, the lower peg, is engaged with the central notch and the other support peg, the upper peg, is engaged with a selected one of the radially oriented notches to orient the shelf-like member at a selected orientation. Successive engagement of the upper peg with each of the radially oriented notches defines a range of inclinations of the media relative to the longitudinal axis of about 180°.

In a preferred configuration, the arcuate portion of the bracket is semi-circular and includes an odd number of equally, circumferentially spaced, radially oriented notches, with the first and last notches positioned 180° relative to one another, to provide a 180° range of inclinations of the media.

Preferably, the bracket includes at least one intermediate radially oriented notch positioned circumferentially about equidistant between the first and last notches to orient the media at about 90° relative to an orientation defined by the first and last notches.

In a preferred arrangement, the system includes a frame for mounting the media thereto. The frame can include a channel to facilitate mounting the bracket to the media. Preferably, the bracket includes an offset therein to provide a space between the media and the support post.

Other features and advantages of the present invention will be apparent from the following detailed description, the accompanying drawings, and the appended claims.

DETAILED DESCRIPTION OF THE PREFERRED EMBODIMENTS

Figure 1:
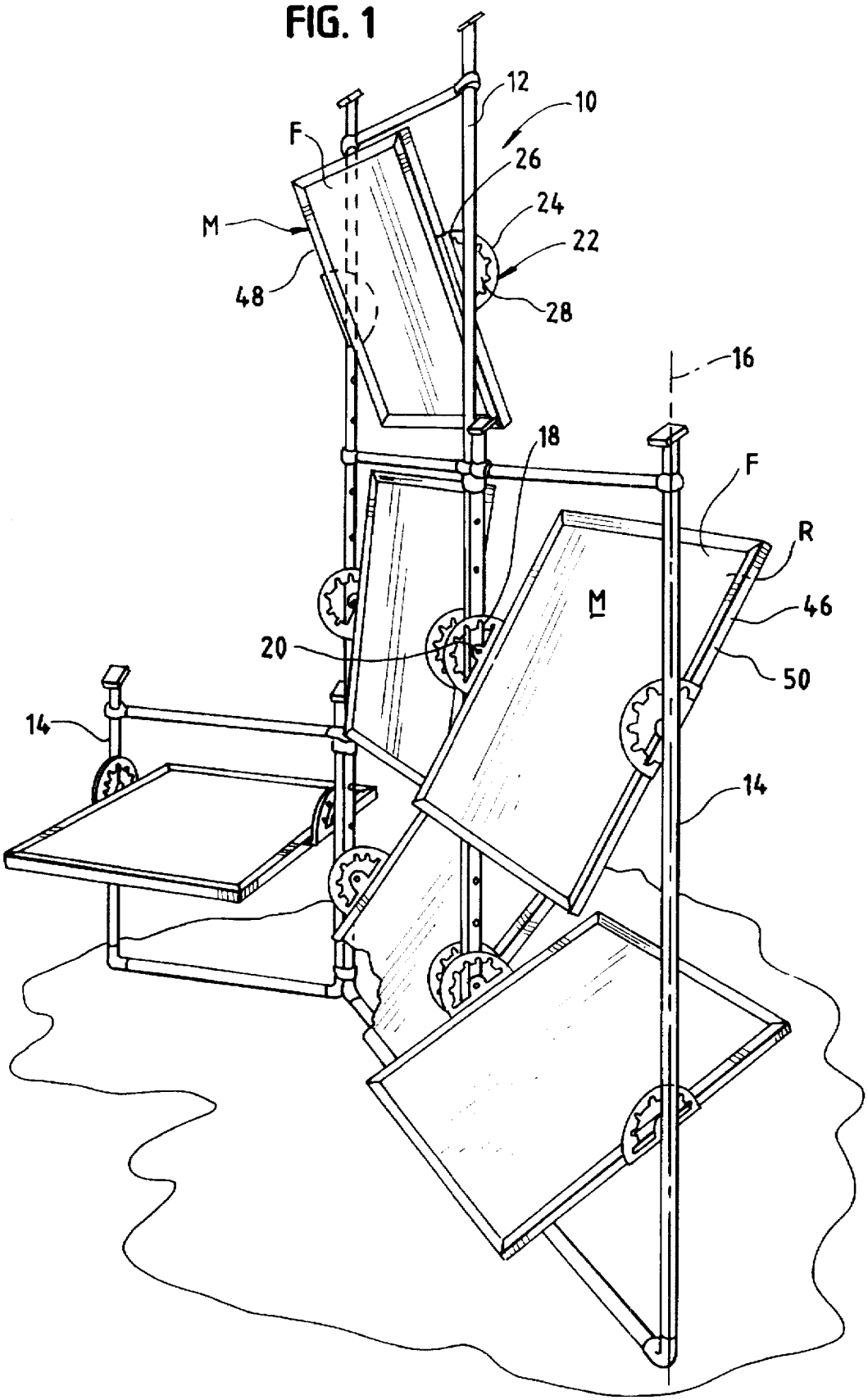
FIG. 1 is a perspective view of a display rack system embodying the principles of the present invention, illustrated with media pieces mounted within the system at various inclinations.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and more particularly to FIG. 1, there is shown a pivotal display rack system 10 in accordance with the principles of the present invention. The rack system 10 is configured to permit mounting a shelf or media M, such as a painting and the like, within a wide range of inclinations including a generally horizontal orientation and a generally vertical orientation.

For purposes of the present discussion, the term media, represented as M in the figures, includes paintings, posters and other flat stock visual articles. It is to be understood that the term media also includes shelves and like supporting structures which may be mounted in a horizontal orientation, and at orientations at angles relative to the horizontal.

As shown in FIG. 1, the system 10 allows the media M to be inclined upward toward the viewer, such as when a viewer's line of sight is above the media M. Likewise, the system 10 permits the media M to be inclined downward toward the viewer, such as when a viewer's line of sight is below the media M.

The flexibility of the present system 10 essentially provides for mounting such media M in a range of inclinations of 360° so that the user can design and erect a customized, aesthetically pleasing and interesting display system 10. Moreover, the system 10 is configured such that the media M inclinations can be readily changed without, for the most part, the use of tools.

The rack system 10 includes a plurality of elongated upright support members, such as the illustrated posts 12. As illustrated, the posts 12 can be full height posts or less than full height (e.g., one-third and two-thirds height posts as illustrated at 14) as desired. Preferably, the posts 12, 14 are fabricated from a relatively light-weight, structurally strong material, such as aluminum, to facilitate handling, assembly and disassembly of the rack system 10. The posts 12 define a longitudinal axis therethrough, as illustrated by the arrow at 16.

The posts 14 each have a pair of pins or pegs 18, 20 extending therefrom. The pegs 18, 20 extend outward from the post 12, generally transverse to the axis 16. The pegs 18, 20 may be fixedly mounted to the posts 12. Alternately, the pegs 18, 20 can be threadedly engaged with the post 12, or the pegs 18, 20 can be biasedly mounted in the post 12, e.g., spring mounted, to bias the pegs 18, 20 outward of the post 12.

Figure 5:
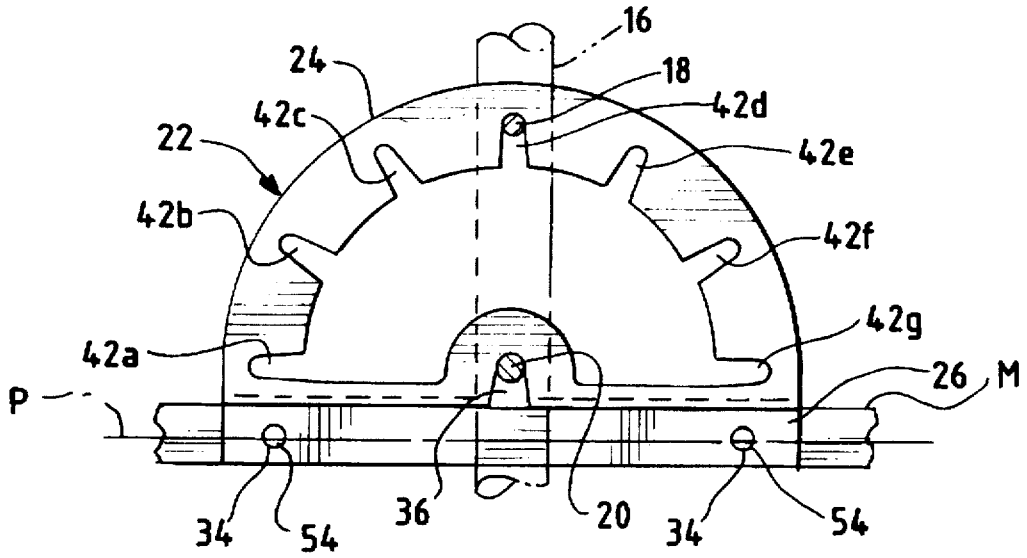
FIG. 5 is a partial side view of the display system, taken along line 5—5 of FIG. 4, illustrated with the support post in phantom lines and with the media positioned in a horizontal orientation.

The display system 10 includes a mounting bracket 22 which mounts to the shelf or media M to be displayed. The bracket 22 includes an arcuate portion 24 and a straight portion 26. The bracket 22, when taken from a side view as illustrated in FIG. 5, has a generally D-shaped configuration. The straight and arcuate bracket portions 24, 26 define an open central region 28. In a preferred embodiment, the arcuate portion 24 is semi-circular.

The straight portion 26 includes a shelf mounting region 30. Preferably, the shelf mounting region 30 includes an offset 32 therein which spaces the media M from the plane of the arcuate portion 24 of the bracket 22. The mounting region 30 may include bores 34 therein to facilitate mounting the bracket 22 to the media M. When mounted to the media M, the bracket 22 defines a mounting plane P.

Figure 2:
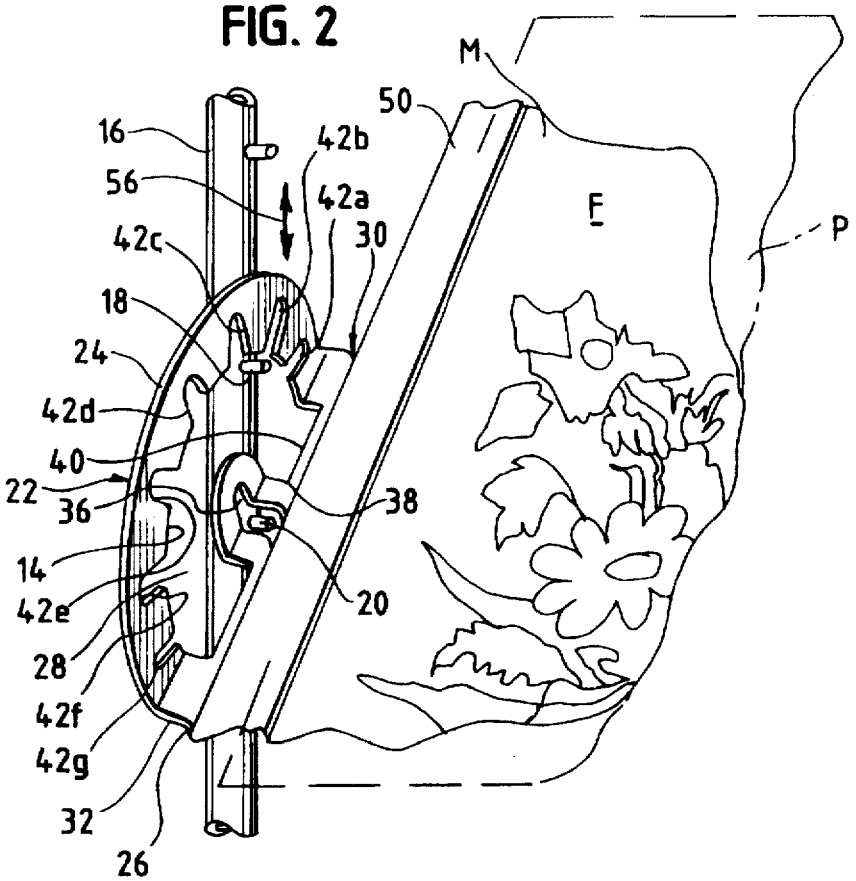
FIG. 2 is a partial front perspective view of the display system of FIG. 1, illustrating the bracket mounting arrangement for displaying media at an upward incline, illustrated with the bracket being engaged with the support post.
Figure 4:
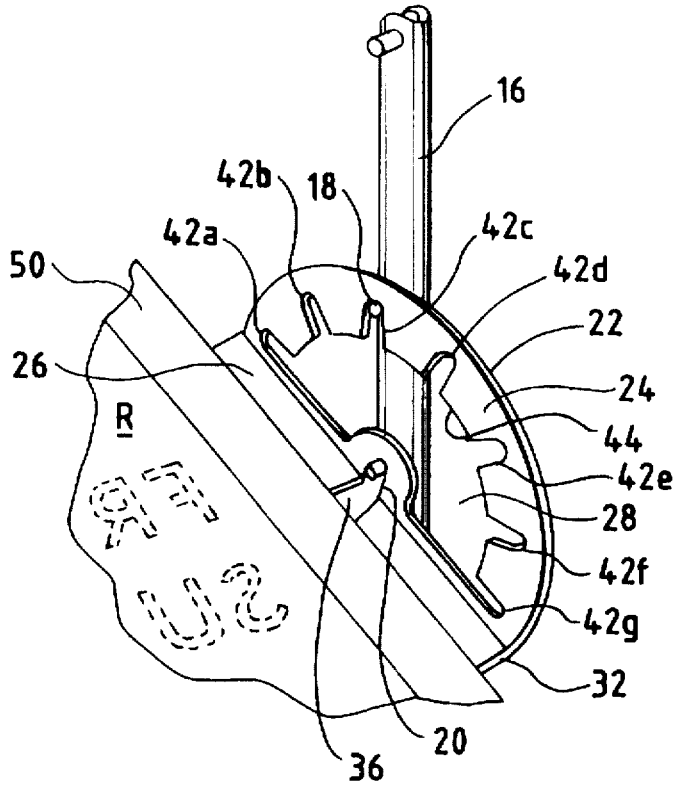
FIG. 4 is a partial rear perspective view of the display system illustrating the bracket mounting arrangement for displaying media at a downward incline.

As best seen in FIGS. 2, 4 and 5, the bracket straight portion 26 includes a notch 36 therein at about the midpoint 38 of the portion 26, adjacent to the offset 32. This central notch 36 is positioned on an outer edge 40 of the bracket 22 and opens outwardly thereof. The arcuate portion 24 includes a plurality of notches 42*a–g* therein positioned on an inner edge 44 of the bracket 22. Preferably, the notches 42*a–g* are positioned so that the two end notches 42*a*, 42*g* are opposingly oriented, circumferentially spaced 180° from one another relative to the central notch 36. In a most preferred configuration, the notches 42*a–g* are equally, circumferentially spaced from one another.

The display rack system 10 permits the media M to be mounted to the rack 10 at a variety of angles. In the illustrated embodiment, the media M can be mounted in a vertical orientation (for purposes of the present illustration, the vertical orientation will be referred to as 0°) and at angles of 30°, 60°, 90°, 120°, 150° and 180°, relative to the vertical orientation. It will of course be recognized that the 90° orientation is the horizontal orientation and that the 180° orientation is the opposing vertical orientation to the 0° orientation.

When the media M is positioned below the eyesight level of a viewer, it may be desirable to angle the media upwardly as illustrated in FIG. 2 and at 46 in FIG. 1. When the media is to be oriented upwardly or vertically (at the 0° orientation), the bracket 22 is mounted to the media M as illustrated in FIG. 2, with the arcuate portion 24 of the bracket 22 positioned toward the front F of the media M. Alternately, when the media M is positioned or angled downwardly (as illustrated at 48 in FIG. 4), the bracket 22 is mounted to the media M with the arcuate portion 24 positioned toward the rear R of the media M.

The present display rack 10 configuration provides a wide variety of design and display alternatives for the user. In the illustrated embodiment, the media M can be mounted to the rack in orientations ranging 360°, in 30° increments. It will be understood by those skilled in the art, that the 30° increments illustrated are for exemplary purposes only, and should not be construed to limit the scope of the present invention.

Figure 3:
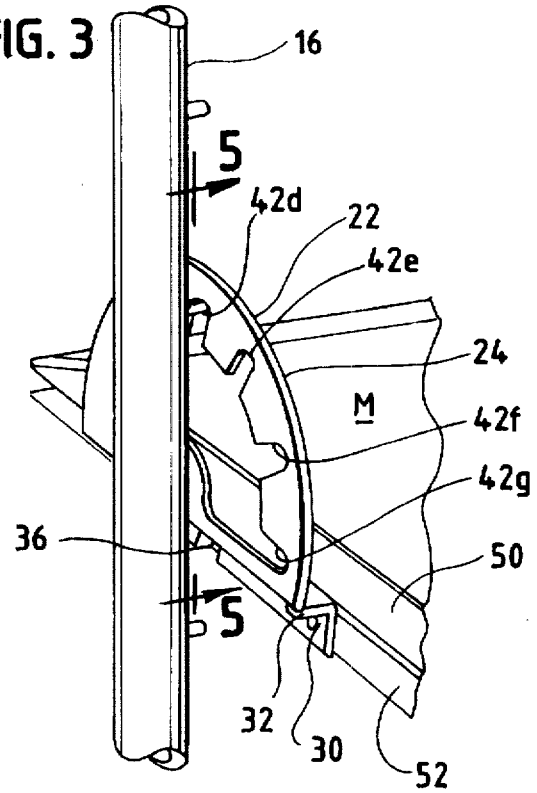
FIG. 3 is a partial side perspective view of the display system illustrating the bracket mounted to the media, shown with the media at about a horizontal orientation.

Referring to FIG. 3, in a preferred arrangement, the media M has a frame 50 mounted thereto. The frame 50 has a channel 52 formed therein, which is configured to readily engage the bracket 22 at mounting region 30. The frame 50 may be pre-assembled so that the media can be mounted therein, or the frame may be mounted directly to the media M.

In use, the user must first determine whether the media M will be mounted in an upward or a downward incline. For the media M to be oriented either vertically or at an upward incline, the bracket 22 is mounted to the media M with the arcuate 24 portion toward the front F of the media M, as illustrated in FIG. 2. Conversely, for the media M to be oriented either vertically or at a downward incline, the bracket 22 is mounted to the media M with the arcuate portion 24 toward the rear R of the media M, as illustrated in FIG. 4. The bracket 22 is mounted to the media M, preferably at the frame portion 50, by fasteners such as screws 54. It is presently contemplated that tool-less, quick connected/disconnect fasteners may be used to connected the bracket 22 to the frame 50.

The media M, with the brackets 22 attached thereto, is then positioned at the rack system 10, such that the central notch 36 of each bracket 22 is adjacent lower pegs 20 of opposing support members 12 and the upper pegs 18 are positioned within the open central region 28 of each of the brackets 22. The desired inclination is then selected and the bracket 22 is positioned onto the pegs 18, 20 by sliding the bracket 22 downwardly, over the pegs 18, 20.

Essentially, the lower pegs 20 which engage the central notches 36 provide a pivot for the bracket 22 and the upper pegs 18 which engage the radially oriented notches 42*a–g* support the particular, desired angle of incline. As will be recognized from the figures, the user can readily adjust the angle of incline of the media M. The media M is raised off of the pegs 18, 20, and the new, desired angle of incline is selected. The media M is then lowered onto the pegs 18, 20 such that the lower pegs 20 engage the central notches 36 and the upper pegs 18 engage the respective radial notches 42*a–g*.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display rack for supporting an associated shelf-like member in a range of inclinations, comprising:

at least one support member having a longitudinal axis;

at least two spaced apart support pegs extending from said support member generally transverse to said longitudinal axis; and a support bracket defining a mounting plane, said bracket being mountable to the shelf-like member and mountable to said support member, said bracket including an arcuate portion and a straight portion contiguous therewith defining an open central region, said straight portion defining a central notch therein discontiguous with said open central region, said arcuate portion defining a plurality of spaced apart, radially oriented notches formed therein contiguous with said open central region, wherein said bracket is engageable with said support pegs having one of said support pegs engageable with said central notch and the other of said support pegs engageable with a selected one of said radially oriented notches for orienting the shelf-like member at a selected orientation, and wherein successively engaging the other of said support pegs with each of said radially oriented notches defines a range of inclinations of said mounting plane of substantially 180 degrees relative to said longitudinal axis.

2. The display rack according to claim 1 wherein said arcuate portion is semi-circular.

3. The display rack according to claim 1 wherein said bracket defines an inner edge and an outer edge, said inner edge defining a periphery of said open central region.

4. The display rack according to claim 1 including an odd number of equally, circumferentially spaced, radially oriented notches, having first and last notches positioned 180° relative to one another, to provide a 180° range of inclinations of said mounting plane relative to said longitudinal axis.

5. The display rack according to claim 4 wherein said bracket includes at least one intermediate radially oriented notch positioned circumferentially about equidistant between said first and last notches to orient said mounting plane and said shelf-like member at about 90° relative to an orientation defined by said first and last notches.

6. The display rack according to claim 1 wherein said bracket includes a mounting region having an offset therein to establish a spacial relation between the shelf-like member and said support member.

7. The display rack according to claim 1 including a frame member adapted to receive said bracket and further adapted to mount to the shelf-like member.

8. A display rack for supporting an associated shelf-like member in a range of inclinations, comprising:

at least a pair of spaced apart, vertically oriented support members, each having a longitudinal axis, said axes being parallel with one another;

at least two vertically spaced apart support pegs extending from each said support member, said pegs being upper and lower support pegs; and a support bracket associated with each said support member said support brackets positioned relative to one another so as to define a mounting plane, each said bracket being mountable to the shelf-like member and mountable to its respective support member, each said bracket including an arcuate portion and a straight portion contiguous therewith defining an open central region, said straight portion defining a central notch therein discontiguous with said open central region, said arcuate portion defining a plurality of spaced apart, radially oriented notches formed therein contiguous with said open central region, wherein said brackets are engageable with said support pegs having said lower support pegs engageable with said central notches and said upper support pegs engageable with corresponding selected ones of said radially oriented notches for orienting the shelf-like member at a selected orientation, and wherein successively engaging said upper support pegs with each of said radially oriented notches defines a range of inclinations of said mounting plane of substantially 180 degrees relative to said longitudinal axes.

9. The display rack according to claim 8 including a frame member adapted to receive said brackets and further adapted to mount to the shelf-like member.

10. The display rack according to claim 9 wherein said bracket includes a mounting region having an offset therein to establish a spacial relation between the shelf-like member and said support member, and wherein said frame includes a channel formed therein for receiving said bracket at about said mounting region.

* * * * *